US005139209A

United States Patent [19]

Kramer

[11] Patent Number: 5,139,209

[45] Date of Patent: Aug. 18, 1992

[54] STORAGE REEL FOR WELDING WIRE

[75] Inventor: Arthur Kramer, So. Euclid, Ohio

[73] Assignee: The Lincoln Electric Company, Cleveland, Ohio

[21] Appl. No.: 692,879

[22] Filed: Apr. 29, 1991

[51] Int. Cl.[5] ..... B65H 75/14; B65H 75/18

[52] U.S. Cl. ..... 242/118.7; 242/117; 242/118.6

[58] Field of Search ..... 242/118.7, 118.4, 118.6, 242/118.61, 118.62, 117, 77, 159, 222

[56] References Cited

U.S. PATENT DOCUMENTS 2,300,650 11/1942 Clinton ..... 242/118.4
3,414,212 12/1968 Baggen et al. ..... 242/118.7
3,592,406 7/1971 Martin et al. ..... 242/117
3,620,471 11/1971 Hubbard et al. ..... 242/118.7

*Primary Examiner*—Stanley N. Gilreath
*Attorney, Agent, or Firm*—Body, Vickers & Daniels

[57] ABSTRACT

A storage reel for copper coated iron welding electrode wire comprises a tubular core of plywood having opposite ends and flanges of plywood at the opposite ends. A vapor barrier layer preferably having outer layers of aluminum foil and an intermediate layer of paper is bonded to the axially inner surfaces of the flanges to provide a barrier against the migration of moisture and other vapor contaminate in the wood material to the welding electrode wire wound on the reel. A method of constructing the reel is also disclosed.

39 Claims, 8 Drawing Sheets

FIG. 10
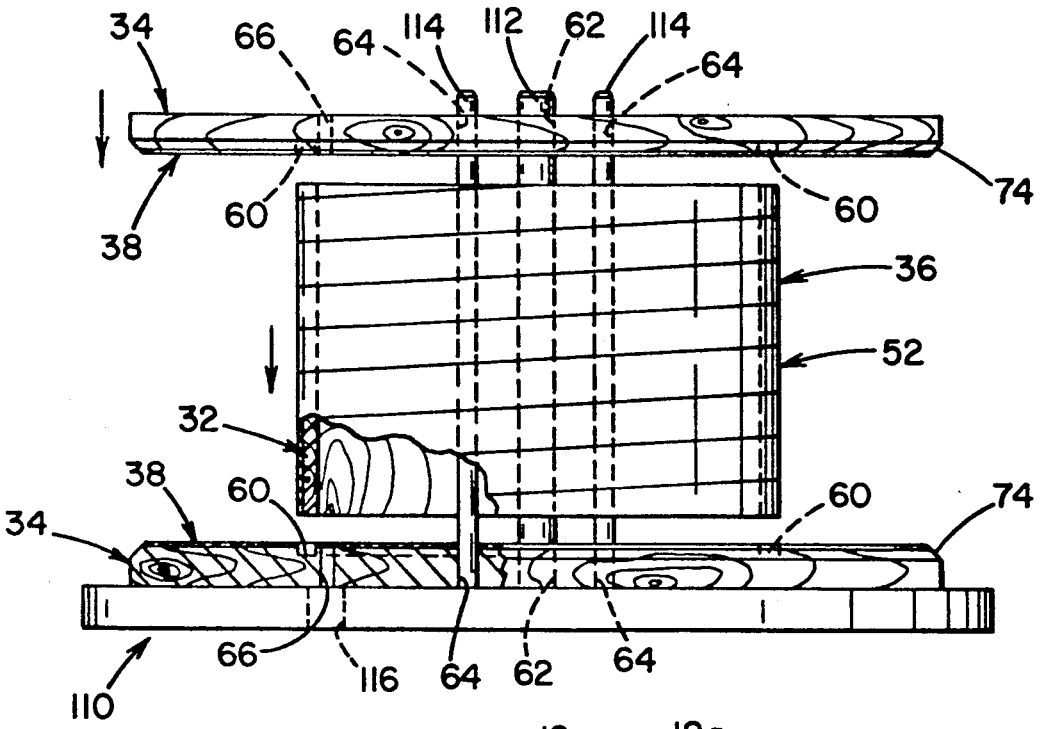
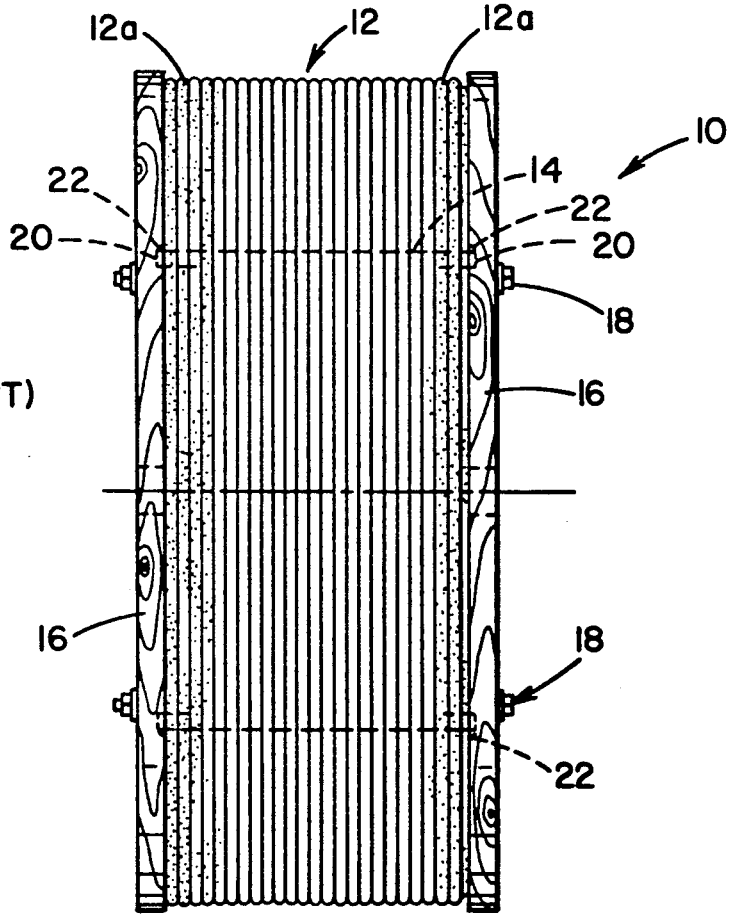
FIG. 11
(PRIOR ART)

STORAGE REEL FOR WELDING WIRE

BACKGROUND OF THE INVENTION

This invention relates to the art of storage reels for wire and, more particularly, to an improved storage reel of wood material for protectively storing a continuous length of electric arc welding electrode wire.

The present invention finds particular utility in the protective storage of a continuous length of electric arc welding electrode wire comprising an iron core and an outer coating of copper. Such electrode wire is sometime subject to discoloration during storage on a wood reel apparently as the result of moisture in the wood material, the temperature of the wire when initially wound onto the reel and/or the decomposition of glues used in the manufacture of the wood materials from which the reels are constructed. Accordingly, the invention will be disclosed and described in detail herein in connection with such electrode wire. At the same time, however, it will be appreciated that the invention is applicable in general to the protective storage of continuous lengths of other electric arc welding electrode wire wherein the material of the electrode is subject to color degradation while stored on a reel of wood material.

As is well known in the art of continuous electric arc welding, a continuous length of welding electrode wire is wound onto a storage reel and is fed therefrom to the point of welding by an appropriate feeding mechanism which progressively unwinds the wire from the storage reel. Often, the storage reel is constructed from wood material such as plywood or bonded and pressure formed boards of aligned wood fiber. Generally, the reels are constructed by assembling a tubular core and end flanges, whereby the reel is in the form of an outwardly open channel for confining the welding wire wound thereon. In one particular reel construction, the flanges are provided with annular recesses to receive the ends of the tubular core and, to facilitate the ease of assembly, the side of the recess adjacent the radially outer surface of the core is chamfered. This provides a grooved area at the juncture between the flanges and core and, in winding the electrode wire thereon, the initial convolutions of the wire are pushed into the grooved area and bind to the extent that they will not freely unwind from the reel during a welding operation. Accordingly, such binding results in the loss of a considerable length of the welding wire.

Discoloration of electric arc welding electrode wire having an iron core and an outer coating of copper was discovered in connection with the storage of such electrode wire on reels made from wood materials of the foregoing character. More particularly, pronounced discoloration of the electrode wire appeared in the convolutions of the wire adjacent the flanges of the reels, such discoloration of the copper coating being blue-black and thus far from the normal sheen of copper. In this respect, in manufacturing the copper coated, iron wire the wire is drawn through drawing dies and immediately wound on the reel upon exiting the last die, and the drawing results in the copper coating having a shinny, bright appearance. The manufacturing process for the coated wire also results in minute interruptions in the copper coating through which the iron core is exposed and thus subject to oxidation. While such discoloration of the welding wire does not affect the quality of a weld made with the wire, users of the wire are sometime not willing to risk product quality and, thus, a reel of electrode wire on which a portion of the wire is discolored may be commercially unacceptable although it is perfectly acceptable for the intended welding function. While the discoloration is only present on those portions of the electrode wire adjacent the reel flanges, if such discoloration renders the electrode wire cosmetically unacceptable to the customer, the entire reel of wire is wasted.

Initially, it was thought that the discoloration of the coated wire was the result of excessive moisture in the wood material from which the reels are constructed. In pursuing the problem in this respect, it was discovered that pre-drying of the wood material of the reels to a moisture content below 3% substantially eliminated the discoloration and rusting problem. However, depending upon the time of storage and the humidity and temperature conditions in the environment of storage, the wood material of the reels would on occasion absorb moisture, whereby discoloration would occur. Furthermore, the process of manufacturing the copper coated iron welding electrode wire results in a high temperature of the coated wire exiting from the last drawing die and being wound on the wooden reels. The high temperature of the wire resulted in substantially immediate discoloration of the welding wire on reels constructed from pre-dried wood. If moisture was the only cause for discoloration, as previously thought, it was not understood why the increase in the temperature of the wire being wound on the reel would cause substantially immediate discoloration, and it was believed therefore that the discoloration problem was the result of more than just the moisture content of the wood material of the reels.

In pursuing the problem, it was discovered that the water soluble Urea formaldehyde glues used in the production of plywood, and pressed particle and fiberboard, decompose in the presence of moisture and heat to form ammonia compounds and formaldehyde. The ammonia compounds turn the copper coating on the wire blue-black, and the formaldehyde oxidizes or rusts exposed portions of the iron core of the wire. Furthermore, glue fillers used in conjunction with filling knot holes and the like in plywood contain free aldehydes which also oxidize or rust the iron core. Since the discoloration problem increases as the moisture content in the wood material increases, even if the electrode wire stored on the reel is cold, it was realized that the predrying of the wood materials from which the storage reels are made, and winding the wire thereon after cooling, would not only be undesirable from the standpoint of manufacturing the wire but, also, would not resolve the discoloration problem. Consequently, oxidation or electrochemical corrosion of the welding wire was undesirable, but was hereto difficult to prevent when using somewhat inexpensive wooden reels.

SUMMARY OF THE INVENTION

In accordance with the present invention, an improved storage reel of wood material is provided for arc welding electrode wire which eliminates the problem of discoloration and/or oxidizing or chemical corrosion of welding wire resulting from moisture and other vapors released from the wood material and/or the temperature of the wire when wound on the reel or during storage thereafter. More particularly in accordance with the invention, the radially outer surface of the reel core and the axially inner sides of the reel flanges, at least from the core to the outer periphery thereof are covered with a barrier material which precludes the migration of moisture or other vapor contaminants in the wood into the area of the reel on which the welding electrode wire is wound and confined. The barrier can be defined by a coating of a thermosetting polymer, or an epoxy resin on the core and flanges, although such coatings are expensive from the standpoint of the cost of the material and the time required to apply and cure the same to prepare the reel for use. The vapor barrier is impervious to vapor, does not transfer material from the barrier to the wire, is ductile and does not fracture and does not decompose at high temperatures, i.e., at least about 700° F. to 1000° F. Preferably, the vapor barrier is defined by a laminate of sheet material which can be readily bonded to the core and flanges in connection with the manufacture and assembly of the reel and which laminate has at least one layer of a material which will preclude migration of moisture and other contaminants from the wood material. In accordance with one embodiment of the invention, the barrier is a laminate of paper and aluminum foil adhesively bonded to the flanges and core with the aluminum foil exposed and providing the desired barrier against migration. In accordance with another embodiment, the barrier is as tri-laminate comprising outer layers of aluminum foil and an intermediate layer of paper, whereby the two layers of aluminum foil provide a double barrier against migration. When the barrier material is in sheet form, it is adhesively bonded to the flanges and core, preferably through the use of a pressure sensitive adhesive.

It will be appreciated that the barrier material can be applied to the appropriate surfaces of the flanges and core either prior to or following assembly of the core components. Preferably, the barrier material is applied to the core and flange components prior to the assembly thereof and, in connection with the reel core, if the barrier material is in sheet form it is preferably spirally wound about the core with axially overlapping side edges. Spiral wrapping of the barrier sheet material about the core advantageously optimizes the quality and continuity of the bond therebetween while reducing the time required to cover the core relative to the time required to cover the latter with a single sheet having a circumferentially overlapping axially extending seam. In this respect, it will be appreciated that it is difficult to conform a single sheet of material to the outer surface of the core without wrinkles and/or bubbles, and to maintain the necessary alignment between the edges of the sheet and the end edges of the core during wrapping thereof. The latter difficulty can be overcome by providing for the sheet to have a width greater than the length of the core so that accurate alignment is not necessary. However, this does not avoid the wrinkling problem and requires trimming of the sheet material after application and thus wastage of the barrier sheet material. It will be appreciated that wrinkling and/or bubbling of the barrier material provides the potential for ruptures in the barrier material when the wire is wound onto the reel and therefore, the potential of adversely affecting the quality and the function of the sheet material as a barrier against migration.

In connection with the manufacture of storage reels in accordance with the present invention, barrier material in sheet form and, preferably, having a layer of water soluble pressure sensitive contact adhesive on the side thereof to be bonded to the wood material is fed from a supply roll into engagement with one side of a continuously moving supply of wood material for the reel flanges, both of which sheet material and wood material move between pressure rolls to bond the barrier material to the wood. Alternatively, the adhesive can be applied to the sheet material at a location between the supply roll and contact of the sheet with the wood. Annular flange blanks are then cut from the covered wood, drilled to provide axle, alignment and bolt holes therethrough, and milled to provide an annular recess for receiving an end of the core with which the flange is ultimately assembled. Preferably, the peripheral edge of the flange on the side thereof provided with the barrier sheet is chamfered to protect the peripheral edge of the barrier sheet from fraying during winding of the welding wire onto the reel. The tubular core is provided with a covering of the barrier sheet material, which is preferably spirally wound thereon as described above, either by hand or by machine, and completely between the opposite ends of the core. One flange of the reel is then positioned on a jig and one end of the core is introduced into the annular recess of the flange after which the other flange is introduced onto the opposite end of the core. The jig provides for the bolt holes through the flanges to be in alignment with one another, whereby completion of the assembly is achieved by introducing bolts through the flanges, interiorly of the core, and axially interengaging the flanges against the core by threading nuts onto the bolts. The annular recesses milled into the flanges preferably have square corners between the bottom and side walls thereof. This provides for the sheet of barrier material on the core to firmly abut against the edge of the barrier material on the flange radially outwardly adjacent the core and, further, eliminates the recessed area at the juncture between the flange recess and core. As described hereinabove, the latter recessed area often results in the loss of a considerable length of welding wire due to the latter being pushed into the recessed area during winding of the wire on the reel and binding to the extent that it will not freely unwind from the reel during a welding operation.

It is accordingly an outstanding object of the present invention to provide an improved reel of wood material for the storage of electric arc welding electrode wire.

Another object is the provision of a storage reel of the foregoing character which protects the electrode wire wound thereon from contamination by vapor, such as moisture, and/or other contaminates in the wood material of the reel.

A further object is the provision of a storage reel of the foregoing character wherein the channel within which the electrode wire is confined is covered with a barrier material which precludes moisture and/or other vapor or contaminates in the wood material of the reel from migrating to the wire.

Yet another object is the provision of a storage reel of the foregoing character which protects welding electrode wire wound thereon from the effects of moisture and/or other contaminants in the wood material of the reel, thus promoting acceptability of the electrode wire and minimizing wastage thereof.

Still a further object is the provision of a storage reel of the foregoing character having an improved structure which precludes wastage of welding electrode wire due to lodging of portions thereof in crevices between the core and flanges of the reel.

Yet a further object is the provision of a method for producing improved storage reels of the foregoing character wherein the core and flanges of the reel are provided with a covering of protective barrier material.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which:

FIG. 10 is an elevation view, partially in section, illustrating the assembly of the flange and core components of the reel;

DESCRIPTION OF PREFERRED EMBODIMENTS

Figure 11A:
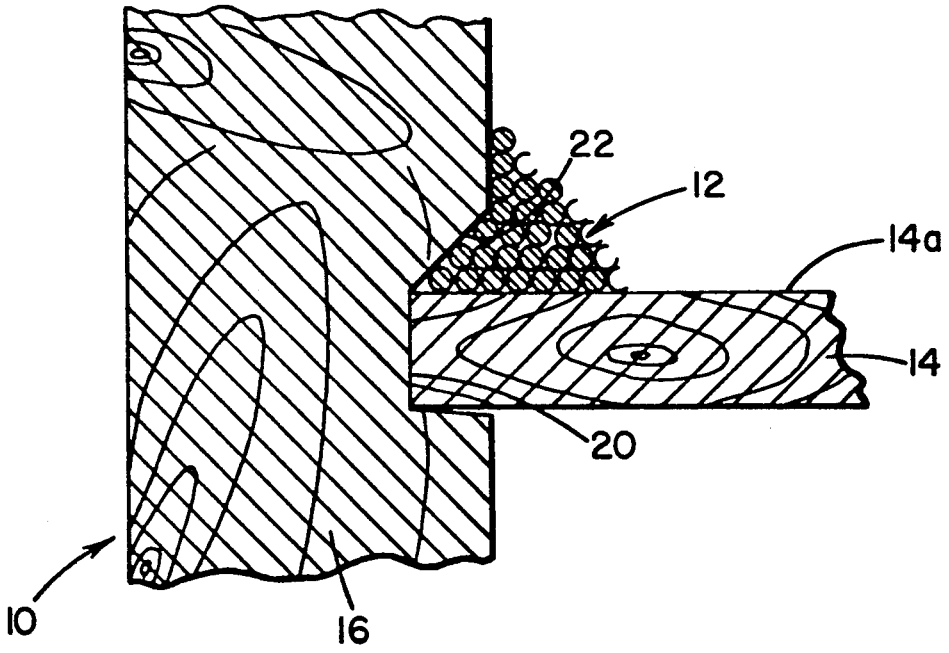
FIG. 11A (PRIOR ART)
FIG. 11 is an elevation view of a prior art storage reel of wood material showing discoloration of the welding electrode wire adjacent the reel flanges; and, FIG. 11A is a detailed view, in section, of a prior art reel of wood material and illustrating the lodging of convolutions of welding electrode wire in a recess adjacent an end of the core and the corresponding flange.

The invention will be described hereinafter with reference in detail to the drawings, wherein the showings are for the purpose of illustrating preferred embodiments of the invention only, and not for the purpose of limiting the invention. Referring first to FIGS. 11 and 11A of the drawings, there is illustrated a prior art storage reel 10 of wood material having electric arc welding electrode wire 12 wound thereon. Such prior art storage reels are comprised of a tubular core 14 and flanges 16 at the opposite ends thereof and interengaged therewith by means of a plurality of nut and bolt assemblies 18. The core and flanges are constructed of wood material, such as plywood, and the inner sides of flanges 16 are provided with annular recesses 20 receiving the corresponding end of core 14. As best seen in FIGURE 11A, side wall 22 of recess 20 adjacent the radially outer surface **14*a* of core 14 is chamfered, such chamfer being provided to facilitate the assembly of the flanges and core. The chamfer provides a groove with the corresponding end of outer surface 14*a* and, as will be appreciated from FIG. 11A, a number of convolutions of the welding wire 12** initially wound on the reel are pushed into the recess. The wire may be as small as 1/32 inch in diameter and, as a result of the force imposed on the convolutions of wire pushed into the groove during winding of the wire on the reel, the convolutions bind and often cannot be freely unwound from the reel, whereby a considerable length of the welding wire is wasted.

More important in connection with the disadvantages of such prior art storage reels is the fact that moisture and other vapor producing constituents in the wood, and/or the combination of moisture in the wood and the temperature of the electrode wire on the reel, results in discoloration and/or oxidation of the welding wire in the areas adjacent the reel flanges, as indicated with respect to the convolutions **12*a* of the wire in FIG. 11. More particularly in this respect, welding electrode wire 12** is comprised of an iron core and an outer coating of copper. In connection with production of the welding wire, when the wire is drawn down to its final diameter the copper coating which is bright and shinny in appearance may have interruptions along the length of the wire through which the iron core is exposed. As explained hereinbefore, the temperature of the wire and/or moisture in the wood material of the reel result in the discoloration of copper coating and the oxidation of the areas of the core exposed through interruptions in the copper coating.

Discoloration of electric arc welding electrodes having an iron core and an outer coating of copper was discovered in connection with the storage of such electrode wire on reels made from wood and/or wood materials. More particularly, pronounced discoloration of the electrode wire appeared on the convolution of the wire adjacent to the flanges of the reels, such discoloration of the copper being blue-black and thus significantly different from the "as manufactured" sheen and color of the electrode. In this respect, in manufacturing the copper coated, iron cored wire, the wire is drawn through drawing dies and wound on the reel upon exiting the final die, and the drawing results in the copper having a shiny, bright, yellowish-red "copper" appearance. While such discoloration of the welding wire does not affect the quality of a weld made with the wire, users of the wire do perceive a significant color difference and some users consciously or subconsciously associated that difference with the quality of the wire. Consequently, a reel on which a portion of the wire is discolored is considered unacceptable or less commercially appealing. While the discoloration is only on those portions of the electrode wire adjacent to the reel flanges, if such discoloration renders the electrode wire unacceptable to the customer, the entire reel of wire is rejected.

Macroscopic and microscopic examination of the areas of welding wire discoloration reveal a vapor attach on the copper surface. It has been discovered that this degradation is related, in a complex way, with moisture in the wood material; the temperature of the wire when initially wound on the reel and/or the ambient temperature of storage; the tannins and other wood chemicals present in the wood, and/or the decomposition of glues and fillers used in the manufacture of the wood materials from which the reels are constructed. Accordingly, the invention will be disclosed and described in detail herein in connection with such electrode wire. At the same time, however, it will be appreciated that the invention is applicable in general to the protective storage of continuous lengths of other electric arc welding wire wherein the material of the electrode is subject to degradation while stored on a reel of wood material.

FIGS. 1-8 of the drawing illustrate a storage reel construction in accordance with the present invention and by which the foregoing problems are minimized or overcome. More particularly in this respect, a storage reel 30 according to the invention is comprised of a tubular core 32 and end flanges 34, both of which are preferably formed of plywood. The radially outer surface of core 32 and the axially inner sides of flanges 34 define a channel in which welding wire is confined when wound onto the reel and, in accordance with the invention, the radially outer surface of core 32 is provided with a covering 36 of barrier material and the axially inner sides of flanges 34 are provided with coverings 38 of barrier material, each of which covering of barrier material precludes the migration of moisture and other contaminants from the wood material to the welding wire wound on the reel.

Figure 4:
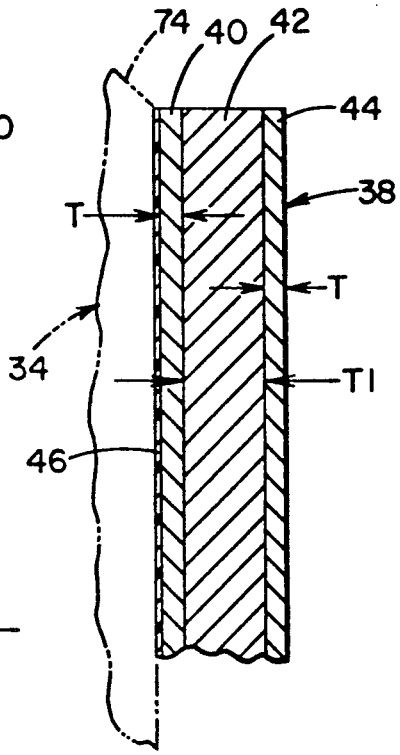
FIG. 4 is an enlarged cross-sectional view illustrating a barrier laminate according to the invention.
Figure 5:
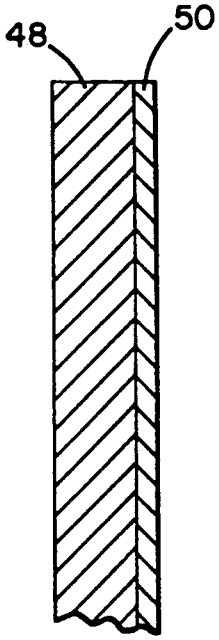
FIG. 5 is an enlarged cross-sectional view of another barrier laminate which can be used in accordance with the present invention.

Preferably, the barrier material providing coverings 36 and 38 is a tri-laminate of paper and aluminum foil which, as shown in FIG. 4 in connection with one of the flanges 34 is comprised of an inner layer of aluminum foil 40, an intermediate layer of paper 42 and an outer layer of aluminum foil 44. Each of the layers of foil has a thickness T, preferably of about 0.5 mil, and the layer of paper has a thickness T1, preferably of about 2 to 3 mil. The barrier material is preferably adhesively bonded to the core and flanges by a layer of water soluble pressure contact adhesive 46 which can be pre-applied to the sheet of barrier material, or applied thereto during manufacture of the flanges as described in greater detail hereinafter. It will be appreciated, of course, that other barrier materials in sheet form can be employed including, for example, a barrier sheet comprising a layer of paper 48 and a layer of aluminum foil 50, as shown in FIG. 5. A laminate of this construction would be bonded to the flanges and core of and reel through an adhesive applied to the exposed side of paper layer 48 so that the layer 50 of aluminum foil is exposed in the channel of the reel in which the welding wire is wound and confined.

Figure 1:
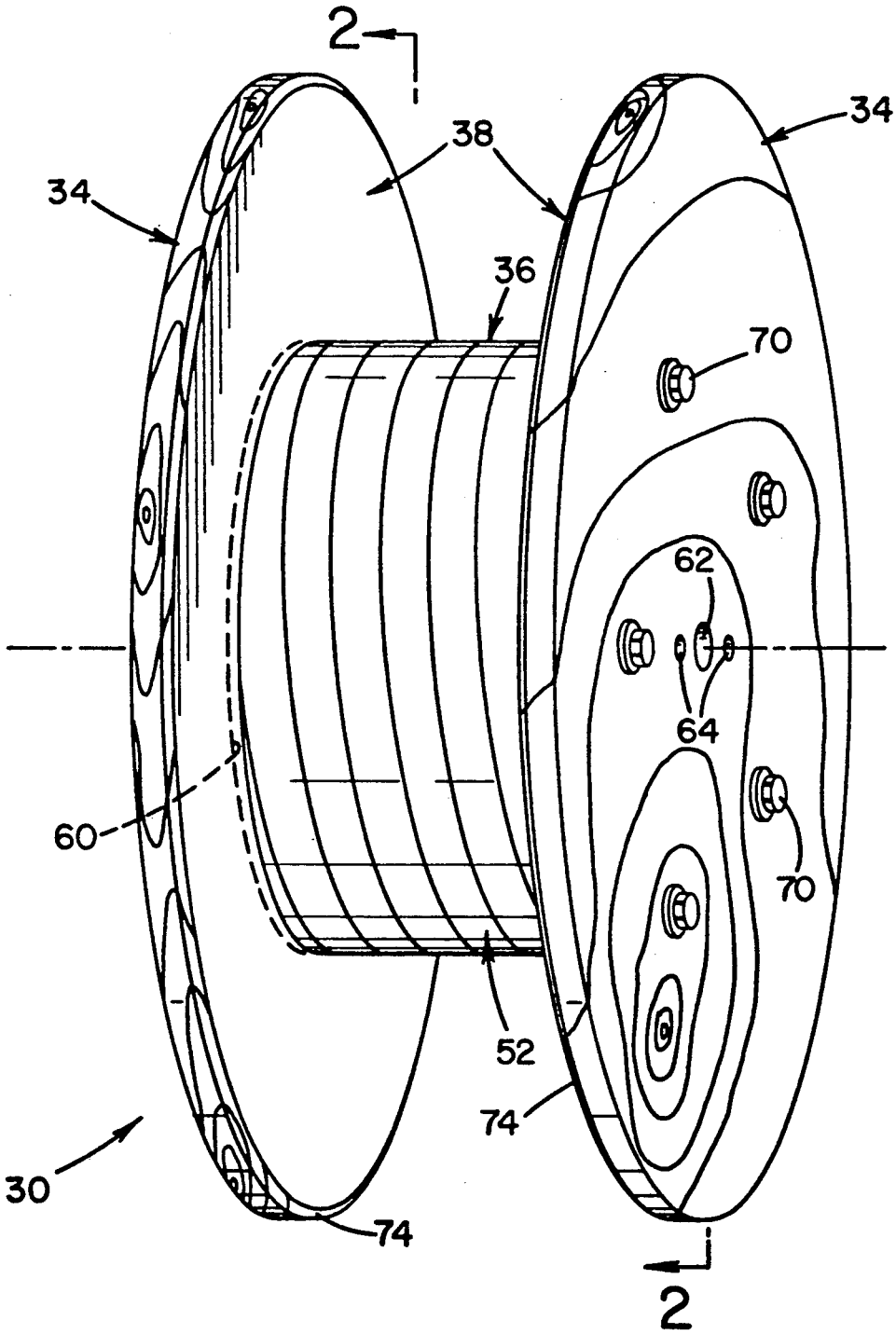
FIG. 1 is a perspective view of a storage reel according to the present invention.
Figure 2:
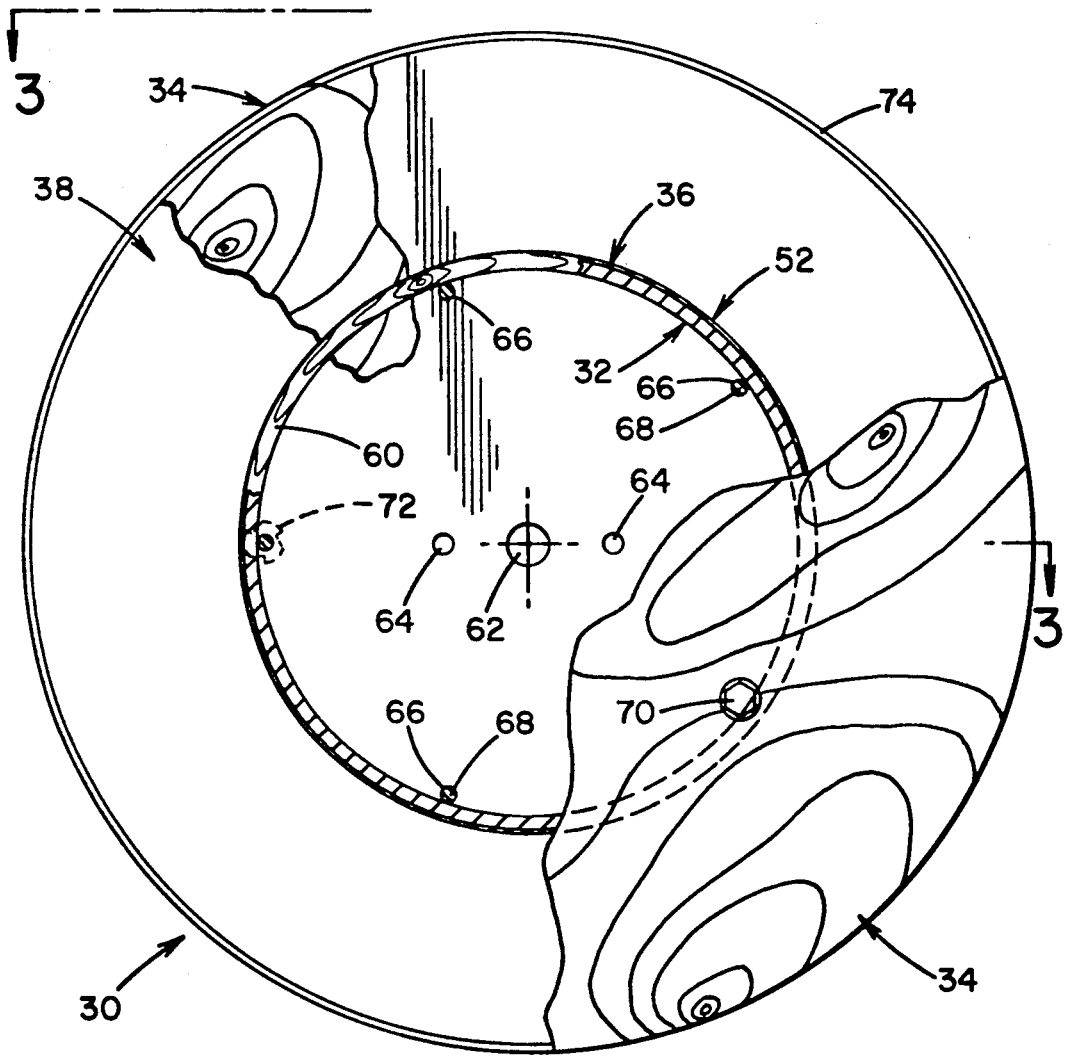
FIG. 2 is a sectional elevation view through the reel taken along line 2—2 in FIG. 1.
Figure 3:
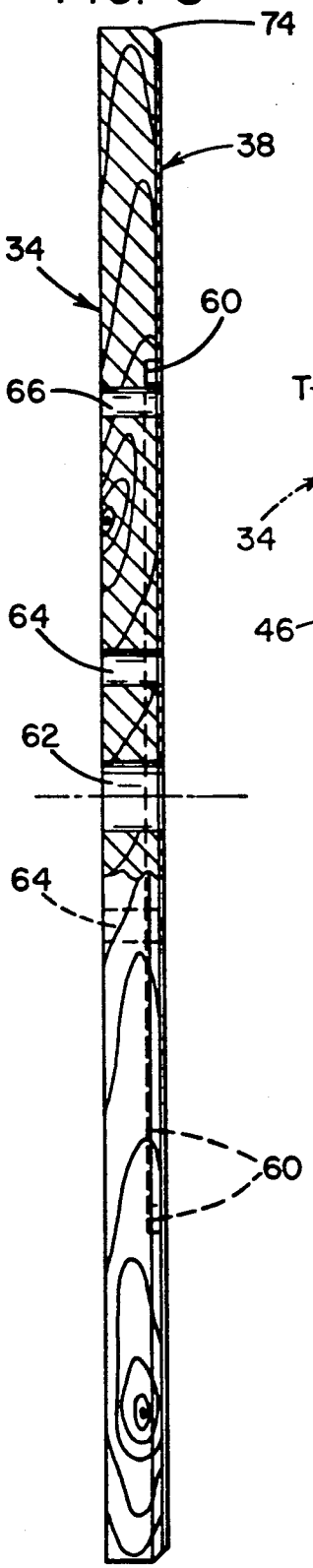
FIG. 3 is an enlarged, partial cross-sectional view of a reel flange taken generally along line 3—3 in FIG. 2.
Figure 7:
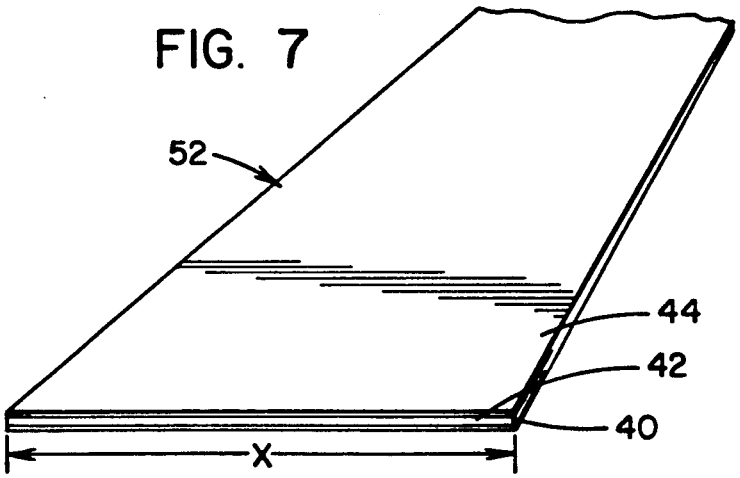
FIG. 7 is a perspective view of the barrier laminate strip spirally wound about the reel core in FIG. 6.
Figure 6:
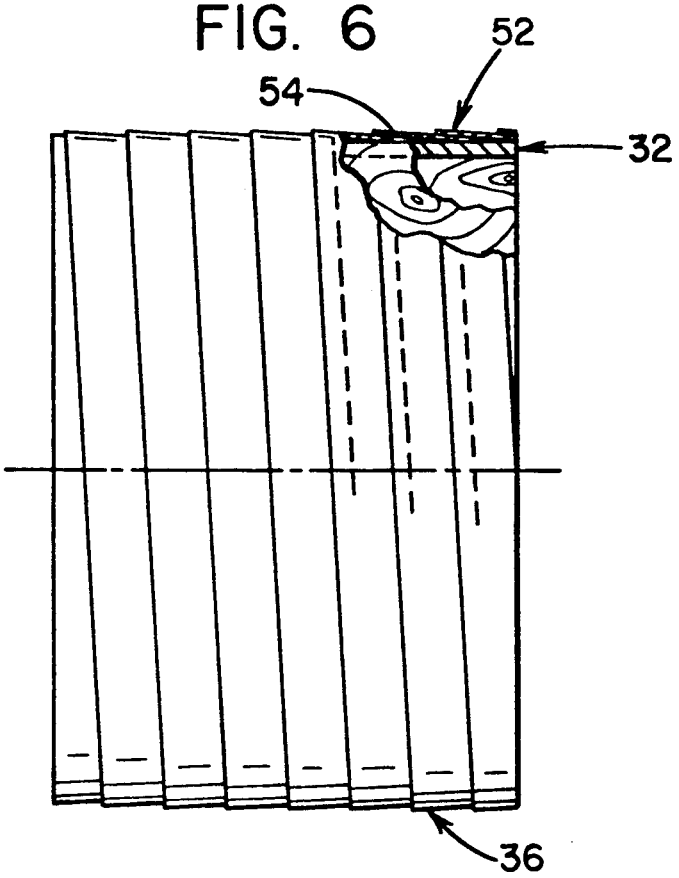
FIG. 6 is an elevation view, partially in section, of the reel core having the barrier laminate spirally wound thereabout.

As best seen in FIGS. 1, 6 and 7 of the drawing, covering 36 of barrier material for core 32 is preferably provided by spirally winding a narrow strip 52 of the tri-laminate barrier material described above about the outer surface of the core between the axially opposite ends thereof. In the embodiment disclosed, core 32 is about 10 inches long and 12 inches in outer diameter, and barrier strip 52 has a width dimension X of between about 1 ½ to 2 inches. While not shown in FIG. 7, it will be appreciated that the exposed side of foil layer 40 is provided with a coating of adhesive as described hereinabove. Preferably, as shown in FIG. 6, barrier strip 52 is spirally wrapped about the outer surface of core 32 so as to provide for overlapping between adjacent convolutions of the strip, as indicated by numeral 54. The spiral wrapping of core 32 optimizes the bond between the core and barrier strip and facilitates applying the barrier covering thereto without wrinkling or bubbling of the barrier material. Further, the overlapped edge portions 54 optimize sealing the core against the migration of moisture and other contaminants therefrom to the electrode wire wound thereon.

Figure 6A:
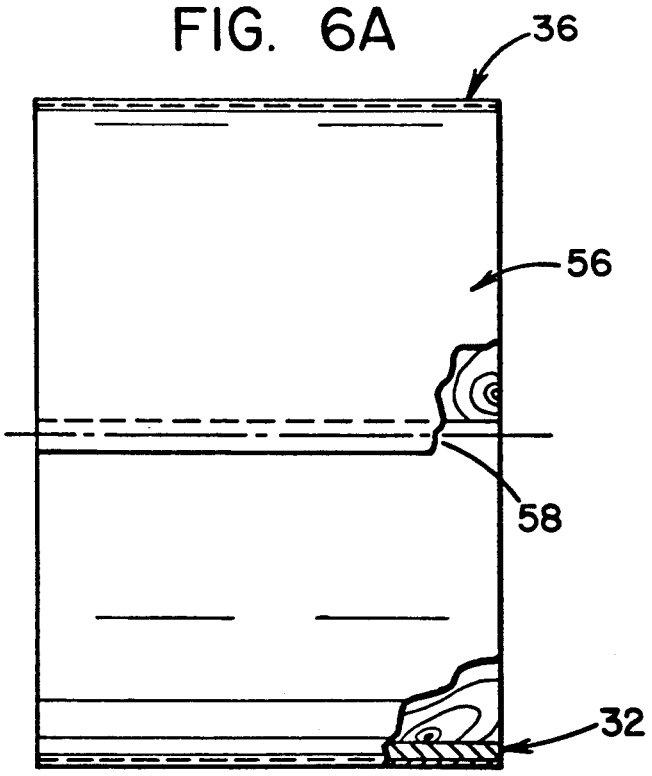
FIG. 6A is a view similar to FIG. 6 and showing the barrier laminate as a single sheet extending about the reel core.

While it is preferred to provide the barrier covering 36 by spirally winding the core as described above in connection with FIG. 6, it will be appreciated as shown in FIG. 6A that barrier cover 36 can be provided by a single sheet 56 of the barrier material applied circumferentially about the core so as to have circumferentially overlapping ends providing an axially extending seam therebetween as indicated by numeral 58. Again, the sheet 56 of barrier material is preferably of the tri-laminate construction described above.

Figure 8:
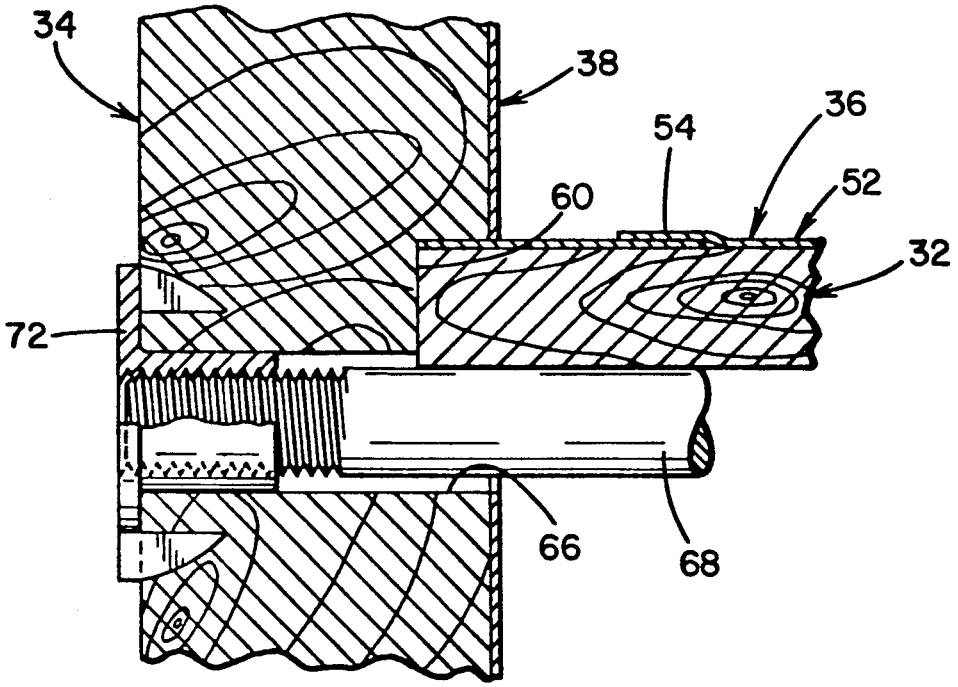
FIG. 8 is an enlarged detailed view, in section, showing the interengaged relationship between the core and a flange of the reel.

With reference now to FIGS. 1-3 and 8 of the drawing, the axially inner side of each flange 34 is provided with a circumferential recess 60 adapted to snugly receive the corresponding end of core 32 and the barrier material thereon, as shown in FIG. 8. Each flange is about 30 inches in diameter and includes a central opening 62 by which the reel is supported for rotation on a suitable shaft during use, and a pair of alignment openings 64 on diametrically opposite sides of opening 62 for the purpose set forth hereinafter. Still further, each of the flanges is provided with a plurality of bolt openings 66 therethrough, which openings are equally spaced apart about the axis of opening 62 and are disposed adjacent the inner surface of core 32. Openings 66 in the flanges at the opposite ends of core 32 are in alignment, and each pair of the openings receives a bolt member of a bolt and nut assembly by which the flanges and core are interengaged. More particularly in this respect, each pair of openings receives a bolt member 68 having a head 70 at one end thereof engaging against the axially outer side of the corresponding flange 34 and having its opposite end threaded to receive a nut 72 of the assembly. The nut is embedded in the outer surface of the flange. The covering 38 of barrier material on each of the flanges 34 abuts at its radially inner end against the barrier material on the outer surface of core 32 and, preferably, the axially inner side of the radially outer end of each flange 34 is chamfered as indicated by numeral 74 so as to protect the circumferential edge of the barrier material from fraying in conjunction with the winding of the electrode wire on the reel.

Figure 9A:
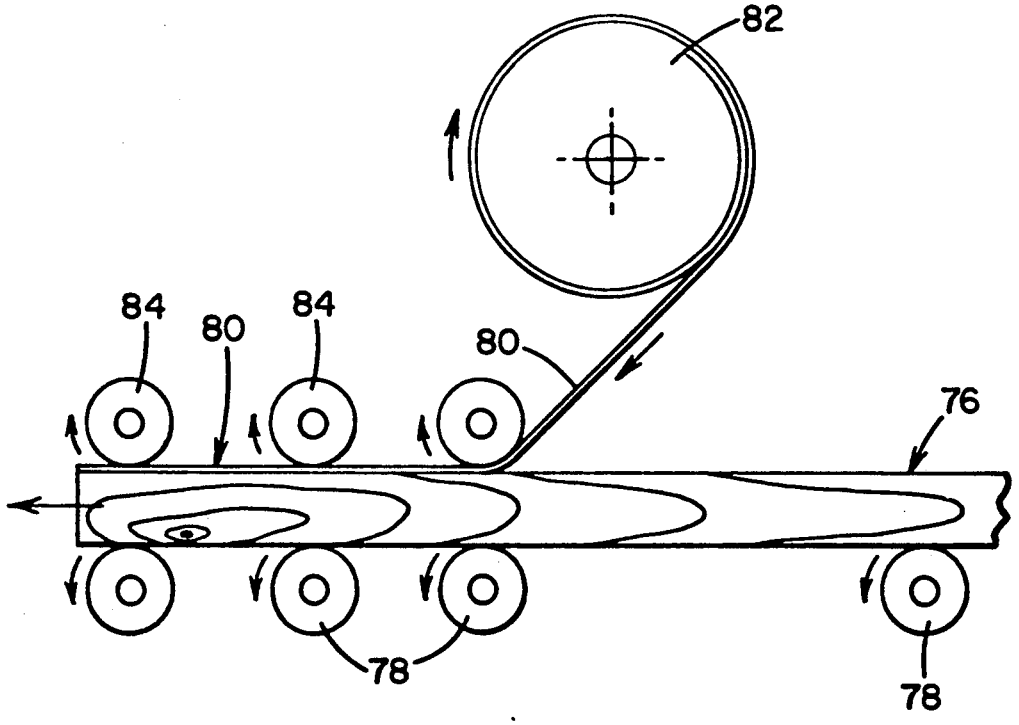
FIGS. 9A-9C schematically illustrate a sequence of steps for manufacturing the reel flanges.
Figure 9B:
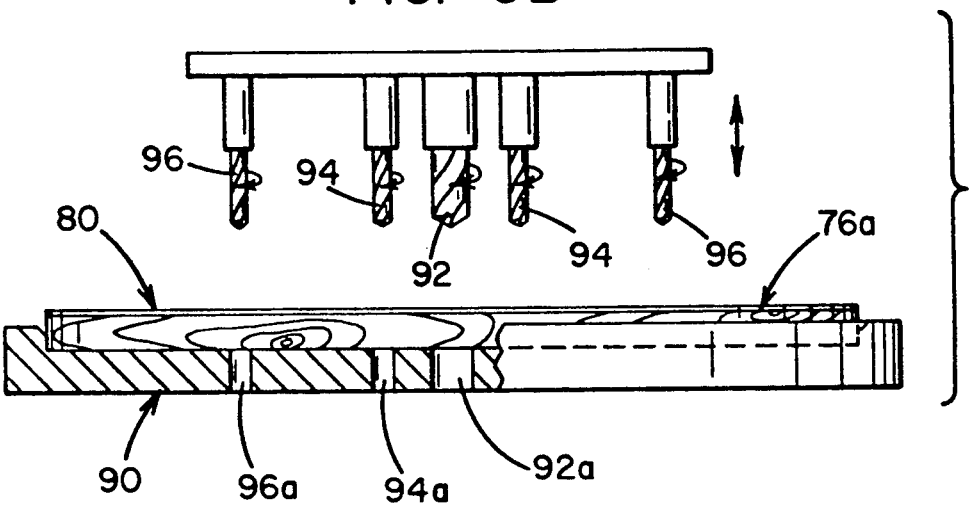
Figure 9C:
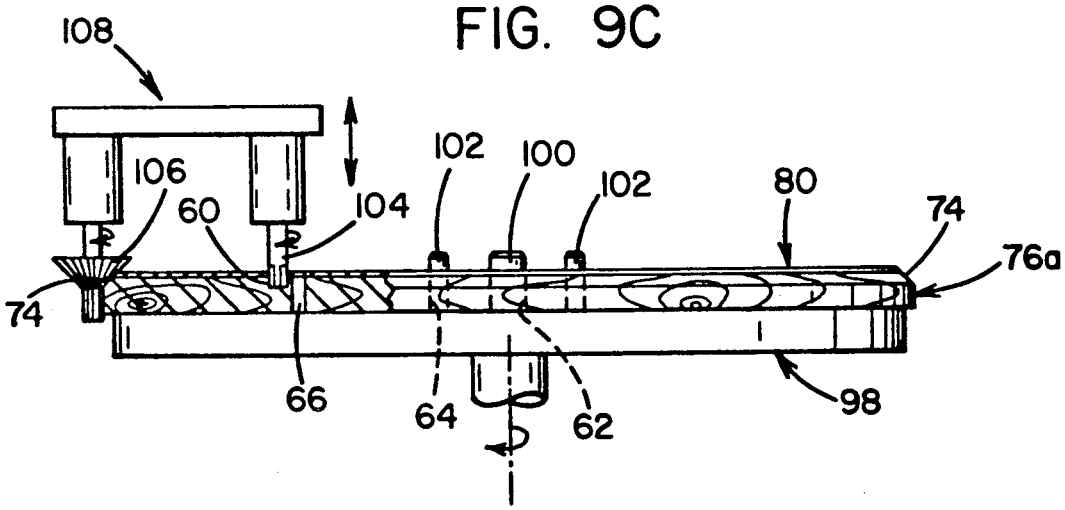

Referring now to FIGS. 9A-9C of the drawing, there is illustrated a sequence of steps for manufacturing the flanges for storage reel 30. With reference first to FIG. 9A, a plywood board 76 is supported on rollers 78 for displacement to the left in FIG. 9A, and tri-laminate barrier sheet material 80 is fed onto the upper side of board 76 from a supply roll 82 with the pre-applied contact adhesive facing board 76. Sheet 80 and board 76 pass between rollers 78 and upper rollers 84, whereby sheet 80 is securely bonded to the board. Board 76 may be of a length to accommodate the manufacture of several flanges or, alternatively, may be square and have dimensions for constructing one flange.

Following bonding of sheet 80 to board 76, the flange blank is then transferred to a support 90 at a drilling station, as shown in FIG. 9B, wherein the blank is supported in alignment with vertically reciprocable and rotatable drills including a center hole drill 92, alignment hole drills 94 and bolt hole drills 96. Support or fixture 90 is provided with openings 92*a*, 94*a* and 96*a* for the corresponding one of the drills 92, 94 and 96 and, upon rotation of the drills and lowering thereof, drill 92 provides center opening 62 in the flange blank, drills 94 provide alignment openings 64 in the flange blank, and drills 96 provide bolt holes 66 in the flange blank. While only two bolt hole drills 96 are shown, it will be appreciated that the number of these drills will correspond with the number of bolt holes to be provided through the flange.

Once flange blank 76*a* is drilled as described above, it is transferred onto a rotatable milling support 98 as shown in FIG. 9C and which support includes a center post 100 and alignment pins 102 respectively extending through the center and alignment openings drilled in the flange blank at the previous station. A rotatable router 104 and a rotatable chamfering tool 106 are mounted on a vertically reciprocable support 108 for displacement upwardly and downwardly relative to support 98 whereby, upon rotation of support 98 after lowering of support 108, router 104 mills annular recess 60 in the inner surface of the flange blank and chamfering tool 106 mills chamfered edge 74 on the flange blank and cuts blank 76*a* into a circular shape of the flange. Of course, the flange could be cut into a circular shape before drilling and the vertical portion of tool 106 will merely finish the edge of the flange.

The milling operation completes construction of a flange 34. As illustrated in FIG. 10 of the drawing, two of the flanges thus constructed are assembled with a wrapped core 32 through the use of an assembly jig 110. Jig 110 includes a center post 112 and alignment posts 114 respectively received in center hole 62 and alignment holes 64 in the two flanges, thus to align corresponding pairs of the bolt holes 66 in the two flanges as well as the circular recesses 60 for receiving the ends of core 32. Further, the jig includes openings 116 in alignment with bolt holes 66 in flange 34 and of a diameter sufficient to accommodate a bolt head 70 or nut 72. The final assembly can be achieved, for example, by positioning the flanges and core on jig 110 as shown in FIG. 10 and bringing the three components together for the opposite ends of core 32 to enter recesses 60 in the two flanges. Thereafter, bolts 68 are dropped through bolt holes 66 in the upper flange and into the corresponding holes 66 in the lower flange, whereby the threaded ends of the bolts extend into the corresponding one of the jig openings 116. The assembly is then completed by applying nuts 72 to the bolts from beneath the jig, and elevating the assembled reel from the jig.

The vapor barrier formed by barrier layers 36, 38 is preferably an aluminum or other foil. This foil is impervious to vapor, does not transfer to the wire to cause contamination from the layers and is stable at high temperature, such as at least about 700° F. to 1000° F. The barrier layers 36, 38 can be a coating of barrier material such as a thermosetting plastic. The barrier can be defined by a coating of a thermosetting polymer reacted on the surface of the wood flange and/or the core. A preferred thermosetting polymer is an acrylated epoxy based polymer system which is initiated by ultraviolet light and/or with a thermal sensitive initiator. A UV-light curable system inherently has advantages over the more traditional methods in that the cure is rapid, typically less than 10 seconds; the cure takes place at room temperature and therefore no heating is required; and there are no solvent emissions. Such coatings are generally expensive from the standpoint of cost of the material since the surface of wood products are generally absorbent and rough. As can be seen, the barrier can be either foil or coating. The coating must have characteristics which do not contaminate the wire. The aforementioned thermosetting polymer accomplishes the objective. By having a curing system which is initiated by radiation, the plastic can be cured rapidly. By adding temperature curing agents, any uncured portion under the exposed upper layer will cure in time.

While considerable emphasis has been placed on the preferred embodiments herein illustrated and described, it will be appreciated that other embodiments of the invention as well as modifications of the preferred embodiments can be made without departing from the principles of the invention. In this respect, for example, barrier material in sheet form can be applied to the flanges and core of the reel after the latter are assembled and, with respect to the flanges, barrier sheet material can be applied thereto prior to assembly so as to only cover the area radially outwardly of the recess receiving the end of the core. These and other modifications will be suggested or obvious from the foregoing description of preferred embodiments of the invention, whereby it is to be distinctly understood that the descriptive matter herein is to be interpreted merely as illustrative of the invention and not as a limitation.

What is claimed is:

1. A storage reel for copper clad steel welding wire comprising, core means of wood material for winding said welding wire upon said reel, said core means having an outer surface and axially opposite ends, flange means for confining said welding wire upon said core means at each of said opposite ends of said core means having axially inwardly facing inner surface, said wire being wound on said reel about said outer surface of said core means and between said inner surfaces of said flanges means, and vapor barrier means for preventing moisture migration covering at least said inner surfaces of said flange means.

2. A storage reel according to claim 1, wherein said vapor barrier means includes aluminum sheet material means for preventing moisture migration bonded to said outer surface and said inner surfaces.

3. A storage reel according to claim 2, wherein said aluminum sheet material means includes a laminate having an outer layer of aluminum and inner layer means for bonding said laminate to said reel, said inner layer means bonded to said outer surface and said inner surfaces.

4. A storage reel according to claim 3, wherein said inner layer means includes a layer of paper material bonded to said outer surface and said inner surfaces.

5. A storage reel according to claim 3, wherein said inner layer means includes an inner layer of aluminum bonded to said outer surface and said inner surfaces and a layer of paper material between said outer and inner layers of aluminum.

6. A storage reel according to claim 4, wherein said outer layer of aluminum has a thickness of about 0.5 mil and said layer of paper material has a thickness of from about 2 to 3 mil.

7. A storage reel according to claim 5, wherein each said outer and inner layer of aluminum has a thickness of about 0.5 mil.

8. A storage reel according to claim 7, wherein said paper material has a thickness of from about 2 to 3 mil.

9. A storage reel according to claim 1, wherein said core means is a tubular core member, each said flange means is a flange member, and said vapor barrier means is bonded to said outer surface of said core member and having a means for interconnecting said flange members with said core member at said axially opposite ends thereof.

10. A storage reel as defined in claim 1, wherein said vapor barrier means is a layer of thermosetting plastic.

11. A storage reel as defined in claim 10, wherein said layer is an acrylated epoxy based polymer.

12. A storage reel as defined in claim 11, wherein said plastic is of a type cured by radiation.

13. A storage reel as defined in claim 12, wherein said plastic includes a thermal sensitive initiator.

14. A storage reel as defined in claim 11, wherein said plastic includes a thermal sensitive initiator.

15. A storage reel as defined in claim 10, wherein said plastic is of a type cured by radiation.

16. A storage reel as defined in claim 10, wherein said plastic is of a type cured at room temperature.

17. A storage reel for copper clad steel welding wire comprising, a tubular core of wood material having an outer surface and axially opposite ends, a flange member of wood material at each of said opposite ends, each of said flange members having axially inwardly facing inner surface means for engaging said tubular core including an inner surface portion extending radially outwardly of said outer surface of said core, means interconnecting said flange members with said core, and a vapor barrier of laminated sheet material covering said outer surface of said tubular core and at least said inner surface portion of each of said flange members.

18. A storage reel according to claim 17, wherein said laminated sheet material includes an outer layer of aluminum and an inner layer of paper material bonded to said outer surface of said core and said inner surface portions of said flange members.

19. A storage reel according to claim 18, wherein said layer of aluminum has a thickness of about 0.5 mil and said layer of paper has a thickness of from about 2 to 3 mil.

20. A storage reel according to claim 17, wherein said laminated sheet material includes outer and inner layers of aluminum and an intermediate layer of paper material, said inner layer of aluminum being bonded to said outer surface of said core and said inner surface portions of said flange members.

21. A storage reel according to claim 20, wherein each said outer and inner layer of aluminum has a thickness of about 0.5 mil and said layer of paper has as thickness of from about 2 to 3 inch.

22. A storage reel according to claim 17, wherein said means interconnecting said flange members with said core includes annular recess means for receiving said axially opposite ends of said tubular core, said recess means in said inwardly facing inner surface means of each said flange member, each said recess means axially receiving the corresponding one of said opposite ends of said tubular core, and bolt and nut means for axially retaining said flange member with said core, said bolt and nut means extending axially through said core and said flange members.

23. A storage reel according to claim 22, wherein said outer surface of said tubular core covered by said laminated sheet material includes said opposite ends of said core received in said recess means.

24. A storage reel according to claim 22, wherein each said recess means includes axially parallel radially spaced inner and outer side walls and said each said opposite ends of said tubular core has parallel radially inner and outer surfaces closely adjacent said side walls of said recess means in the corresponding one of said flange members.

25. A storage reel according to claim 24, wherein said outer surface of said tubular core covered by said laminated sheet material includes said opposite ends of said core received in said recess means.

26. A storage reel according to claim 24, wherein said laminated sheet material includes an outer layer of aluminum and an inner layer of paper material bonded to said outer surface of said core and said inner surface portions of said flange members.

27. A storage reel according to claim 26, wherein said layer of aluminum has a thickness of about 0.5 mil and said layer of paper has a thickness of from about 2 to 3 mil.

28. A storage reel according to claim 17, wherein said laminated sheet material covering said outer surface of said core is spirally wrapped around said core between said opposite ends thereof.

29. A storage reel according to claim 28, wherein said laminated sheet material includes an outer layer of aluminum and an inner layer of paper material bonded to said outer surface of said core and said inner surface portions of said flange members.

30. A method of manufacturing a storage reel for welding wire comprising providing a reel having core and end flanges of wood material defining an annular channel for confining welding wire wound onto said reel, and covering said channel with a vapor barrier layer, said vapor barrier layer being substantially impervious to vapor, stable at high temperature and not adhering to welding wire.

31. The method according to claim 30, wherein said core has an outer surface providing a bottom wall for said channel and said flanges have inner surfaces providing side walls for said channel, and wherein said covering step includes covering each said outer surface and said inner surfaces with said vapor barrier layer material.

32. The method according to claim 31, wherein said covering step further includes spirally wrapping said outer surface of said core with the corresponding sheet of said vapor barrier layer material.

33. The method according to claim 32, wherein said vapor barrier material is a laminate including a layer of aluminum, and said covering step includes covering said outer and inner surfaces of said channel so that said layer of aluminum is the exposed outside surface of said channel.

34. The method according to claim 33, and bonding said laminate to said outer surface and said inner surfaces of said channel.

35. The method according to claim 30, wherein said vapor barrier material is a laminate including a layer of aluminum, and said covering step includes covering said channel so that said layer of aluminum is the exposed outside surface of said channel.

36. The method according to claim 35, and bonding said laminate to said outer surface and said inner surfaces of said channel.

37. A method of constructing a storage reel for welding wire comprising, providing, a tubular core of wood material having opposite ends, providing a pair of flanges of wood material, covering the outer surface of said core and one side of each flange with a laminate including an exposed layer of aluminum, and attaching said flanges to said opposite ends of said core with said one sides thereof facing one another.

38. The method according to claim 37, wherein said covering step includes covering said outer surface of said core by spirally wrapping said laminate thereabout.

39. The method according to claim 38, and bonding said laminate to said outer surface of said core and to said one side of each of said flanges.

* * * * *